US008720852B2

(12) United States Patent
Frank et al.

(10) Patent No.: US 8,720,852 B2
(45) **Date of Patent: *May 13, 2014**

(54) PROCEDURE FOR POSITIONING THE ACTUATING DRIVE IN A FUEL INJECTOR AND DEVICE FOR PERFORMING THE PROCEDURE

(75) Inventors: Wilhelm Frank, Bamberg (DE); Stefan Lehmann, Lappersdorf (DE); Martin Neumaier, Isen (DE); Gerd Schmutzler, Tegernheim (DE); Wendelin Kluegl, Seubersdorf (DE); Guenter Lewentz, Donaustauf (DE); Reda Rizk, Cologne (DE)

(73) Assignee: Continental Automotive GmbH, Hannover (DE)

( * ) Notice: Subject to any disclaimer, the term of this patent is extended or adjusted under 35 U.S.C. 154(b) by 735 days.

This patent is subject to a terminal disclaimer.

(21) Appl. No.: 11/778,407

(22) Filed: Jul. 16, 2007

(65) Prior Publication Data

US 2008/0011972 A1 Jan. 17, 2008

Related U.S. Application Data

(60) Division of application No. 10/758,592, filed on Jan. 16, 2004, now Pat. No. 7,310,986, which is a continuation of application No. 09/743,183, filed as application No. PCT/DE00/01408 on May 4, 2000, now Pat. No. 6,705,587.

(30) Foreign Application Priority Data

May 7, 1999 (DE) ..... 199 21 242

(51) Int. Cl.
*F02M 61/16* (2006.01)

(52) U.S. Cl.
USPC ..... 251/129.06; 251/368

(58) Field of Classification Search
USPC ..... 251/129.06, 368, 129.15, 129.2, 251/129.16, 129.18; 239/585.1, 239/585.4–585.5
See application file for complete search history.

(56) References Cited

U.S. PATENT DOCUMENTS

| | | | | |
|---|---|---|---|---|
| 2,675,022 | A * | 4/1954 | Bohn | 137/597 |
| 3,194,162 | A * | 7/1965 | Williams | 239/102.2 |
| 3,524,474 | A | 8/1970 | McCormick | 251/57 |
| 3,648,967 | A | 3/1972 | O'Neill et al. | 60/329 |
| 3,656,769 | A * | 4/1972 | Jelinek et al. | 285/363 |
| 4,022,166 | A * | 5/1977 | Bart | 251/129.06 |
| 4,101,076 | A | 7/1978 | Bart | 239/584 |

(Continued)

FOREIGN PATENT DOCUMENTS

| | | | |
|---|---|---|---|
| DE | 3533521 A1 | 4/1987 | F02M 51/06 |
| DE | 29708546 U1 | 9/1988 | F15B 5/00 |

(Continued)

*Primary Examiner* — John Bastianelli
(74) *Attorney, Agent, or Firm* — King & Spalding L.L.P.

(57) ABSTRACT

The positioning of the actuating drive in a fuel injector with a piezoactuator (2) that is screwed into the housing (1) of the fuel injector is performed by applying a voltage (U) to the piezoactuator (2) that corresponds to a given idle stroke (h), and the surface grinding of the housing (3) and base plate (4) of the piezoactuator (2) when voltage is applied. Between the housing (1) of the fuel injector and the housing (3) of the piezoactuator (2), there is also provided a compensation collar (9) of a suitable thickness.

14 Claims, 1 Drawing Sheet

(56) References Cited

U.S. PATENT DOCUMENTS

| | | | | | |
|---|---|---|---|---|---|
| 4,176,822 | A | * | 12/1979 | Chadwick | 251/129.06 |
| 4,281,819 | A | * | 8/1981 | Linder | 251/284 |
| 4,316,374 | A | * | 2/1982 | Nagatsuma | 72/91 |
| 4,365,747 | A | * | 12/1982 | Knapp et al. | 239/585.3 |
| 4,379,403 | A | * | 4/1983 | Hattori et al. | 73/35.09 |
| 4,553,059 | A | * | 11/1985 | Abe et al. | 310/328 |
| 4,584,980 | A | * | 4/1986 | Weiger et al. | 251/129.06 |
| 4,593,658 | A | * | 6/1986 | Moloney | 251/129.04 |
| 4,610,080 | A | * | 9/1986 | Hensley | 239/585.4 |
| 4,750,514 | A | * | 6/1988 | Omori et al. | 137/339 |
| 4,762,300 | A | | 8/1988 | Inagaki et al. | 251/129.06 |
| 4,825,680 | A | * | 5/1989 | Coe et al. | 72/359 |
| 4,832,314 | A | * | 5/1989 | Trott | 239/585.3 |
| 4,923,122 | A | * | 5/1990 | Morini et al. | 239/585.5 |
| 5,165,653 | A | | 11/1992 | Weber | 251/57 |
| 5,209,453 | A | | 5/1993 | Aota et al. | 251/57 |
| 5,335,861 | A | * | 8/1994 | Matusaka | 239/533.7 |
| 5,417,142 | A | | 5/1995 | Lohmann | 91/459 |
| 5,740,969 | A | | 4/1998 | Hoffmann et al. | 239/533.2 |
| 5,779,149 | A | | 7/1998 | Hayes, Jr. | 239/124 |
| 6,062,532 | A | | 5/2000 | Gurich et al. | 251/57 |
| 6,076,800 | A | | 6/2000 | Heinz et al. | 251/129.06 |
| 6,085,990 | A | | 7/2000 | Augustin | 239/88 |
| 6,126,094 | A | * | 10/2000 | Ricco | 239/585.1 |
| 6,131,829 | A | | 10/2000 | Ricco | 239/585.1 |
| 6,148,842 | A | * | 11/2000 | Kappel et al. | 251/129.06 |
| 6,186,474 | B1 | * | 2/2001 | Fitzner et al. | 251/129.2 |
| 6,279,842 | B1 | * | 8/2001 | Spain | 239/585.1 |
| 6,607,178 | B1 | | 8/2003 | Lixl et al. | 251/229 |

FOREIGN PATENT DOCUMENTS

| | | | | |
|---|---|---|---|---|
| DE | 43 06 072 | A1 | 9/1994 | F15B 3/00 |
| DE | 44 34 892 | A1 | 4/1996 | F02M 47/02 |
| DE | 195 19 192 | C1 | 6/1996 | F02M 59/34 |
| DE | 195 38 791 | A1 | 4/1997 | F02M 51/06 |
| DE | 197 02 066 | A1 | 7/1998 | F02M 51/06 |
| DE | 3713697 | | 11/1998 | F16K 31/02 |
| DE | 19803842 | | 11/1998 | F15B 5/00 |
| DE | 197 42 943 | C1 | 4/1999 | F02M 51/06 |
| EP | 0 199 632 | | 4/1986 | F02M 47/02 |
| EP | 0 816 670 | A1 | 7/1998 | F02M 47/02 |
| EP | 0 916 843 | A1 | 5/1999 | F02M 47/02 |
| GB | 2 180 887 | | 4/1987 | F02M 51/06 |
| WO | 99/17014 | | 4/1999 | F02M 51/06 |

* cited by examiner

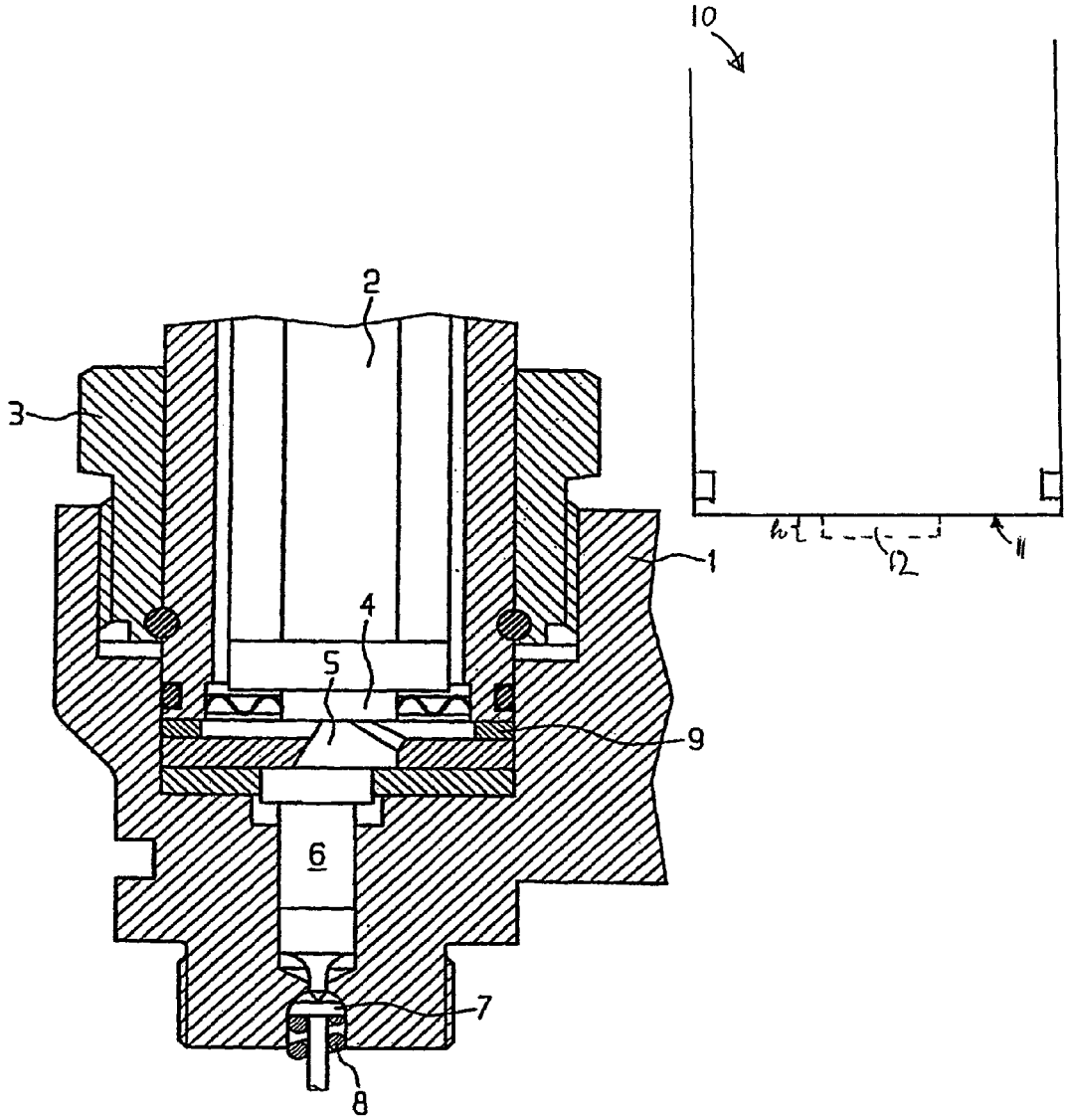
10
2
3
1
4
5
9
6
7
8
12
11

PROCEDURE FOR POSITIONING THE ACTUATING DRIVE IN A FUEL INJECTOR AND DEVICE FOR PERFORMING THE PROCEDURE

CROSS-REFERENCE TO RELATED APPLICATION

This application is a divisional of U.S. patent application Ser. No. 10/758,592 filed Jan. 16, 2004, now U.S. Pat. No. 7,310,986 which is a continuation of U.S. patent application Ser. No. 09/743,183 filed May 14, 2001, now U.S. Pat. No. 6,705,587, which is a national stage application of International Application No. PCT/DE00/01408 filed May 4, 2000, the contents of which are hereby incorporated in their entirety by reference.

TECHNICAL FIELD

The invention involves a procedure for positioning the actuating drive in a fuel injector and a device for performing the procedure.

BACKGROUND

Reservoir injection systems using very high injection pressures and high switching speeds are being increasingly used in the fuel supply of combustion engines. Such injection systems are known as common rail systems (for diesel engines) and HPDI injection systems (for Otto engines). In these reservoir injection systems, the fuel is fed into a high-pressure reservoir common to all cylinders. The fuel is then injected into the individual combustion chambers of the combustion engine by means of fuel injectors.

The fuel injector generally includes an injection valve that is opened and closed hydraulically by a servo valve in order to precisely set the timing of the injection process in the combustion chamber.

The servo valve is actuated by an electrically triggered actor. The use of piezoelectric actors has proven to be particularly effective in achieving sufficiently short switching times. In this kind of piezoelectric actor, longitudinal extension that is transferred to the servo valve which then again opens or closes the injection valve is brought about by the application of electrical voltage. For the longitudinal extension of the piezoelectric actor, which is in the μm range, to be able to actuate the servo valve, this longitudinal extension is generally either mechanically assisted by lever gears with bearings in fuel or hydraulically amplified by a pressure chamber.

A fuel injector with a piezoactuator and hydraulic amplification is described, for example, in U.S. Pat. No. 5,779,149.

In order to be able to attain the high switching speeds required for optimal combustion timing and small injection amounts with the fuel injector, it is necessary to adjust the fuel injector very precisely.

This applies particularly to the idle stroke between the piezoelectric actor and the, servo valve. On the one hand, the idle stroke should be as small as possible to have constantly defined conditions and to keep the dynamic loads low. On the other hand, there must be minimal play between the actor and the adjusting element in order to avoid malfunctions during operation.

The setting of the idle stroke in the fuel injector has previously be done in such a way that the exact configuration of the individual components of the fuel injector and especially spaces between them are determined by computer from the dimensions of these components.

For that purpose, each component has to be measured at considerable expense. After measurement, the idle stroke is then set by adjustment disks placed between the injector housing and the actor or the servo valve; these disks must have only very close tolerances and are therefore very expensive to manufacture.

To check the adjusted idle stroke, it has previously been necessary to assemble the fuel injector completely and to test it under operating conditions. If malfunctions are found, the fuel injector must be completely broken down again into its individual parts after the test run and possibly reworked or the adjustment disks must be replaced.

SUMMARY

It is the task of this invention to create a procedure for positioning the actuating drive in a fuel injector and a device for performing such a procedure in which it is possible to reliably position the actuating drive in the fuel injector at little expense and to allow operational production-line testing of the fuel injector.

This object may be achieved by a method for producing a compensation collar for an injection valve, comprising the steps of inserting the compensation collar between two flat areas and plastically deforming the compensation collar to a presettable thickness by compressing the two areas together.

According to an embodiment, the compensation collar may consists of a flowable material, and the material of the compensation collar begins to flow during the compression and is thereby permanently plastically deformed. According to an embodiment, the compensation collar may be inserted into a housing of a fuel injector, the compensation collar being arranged in the area of an actuating drive which projects into an opening of the compensation collar, and the compensation collar is pressed against the housing with a prestressing device until the prestressing device has moved the actuating drive into a presettable position, the thickness of the compensation collar being reduced. According to an embodiment, the prestressing device in the areas that act on the actuating drive may have a boss with a given height, and the boss is surrounded by a circumferential edge set back by the given height, this edge adjoining the compensation collar. According to an embodiment, the actuating drive can be a servo valve, and the given position corresponds to the opening of the servo valve. According to an embodiment, the compensation collar can be made of soft iron or soft copper.

The object can also be achieved by an injection valve comprising a piezoactuator having a housing with an opening, the piezoactuator being movable in the housing and moving in direction of the opening when triggered and making connection with an actuator, wherein between the housing of the piezoactuator and the housing of the injection valve, a compensation collar is arranged, the thickness of which has been adjusted by plastic deformation.

The object can also be achieved by an injection valve comprising a piezoactuator arranged within a housing and being arranged to be movable in the housing and moving in direction out of the housing when triggered and making connection with an actuating drive, wherein the end of the piezoactuator adjoining the actuating drive has a given idle stroke distance from the leading edge of the housing, the leading edge of the housing is arranged at the level of the actuating drive, and a compensation collar arranged between the housing and the piezoactuator for compensating tolerances in the idle stroke distance.

According to an embodiment, the compensation collar may consist of a soft, deformable material. According to an embodiment, the compensation collar may consists of soft iron or soft copper. According to an embodiment, the thickness of the compensation collar has been adjusted by plastic deformation.

BRIEF DESCRIPTION OF THE DRAWINGS

Embodiments of the invention are illustrated below in more detail in the FIGURE. The FIGURE shows a cross-section view of a fuel injector in the area of the connection between a piezoactuator and an actuating drive for a servo valve.

DETAILED DESCRIPTION

The above can, thus, be achieved by adjusting the idle stroke in such a way that a defined electrical voltage is applied to the piezoactuator before it is mounted in the fuel injector so as to cause a longitudinal extension of the piezoelements that corresponds exactly to the desired idle stroke. In this state, i.e., with voltage applied, the baseplate of the piezoactuator is surface ground with the actor housing. In the no-current or no-voltage state, the baseplate stands back from the actor housing by the idle stroke distance. According to an embodiment, a compensation collar can be provided between the piezoactuator and the housing of the fuel injector. The compensation collar is inserted into the fuel injector that is now completely assembled up to the piezoactuator, and is deformed by a prestressing device with a flat effective area until the servo valve lifts up from its valve seat. If, instead of the prestressing device, the piezoactuator is then screwed into the injector housing to the stop on the compensation collar, the idle stroke set as indicated above is necessarily adjusted between the baseplate of the piezoactuator and the adjustment element of the fuel injector servo valve. In this way an effective connection is formed between the piezoactuator and the adjustment element for the servo valve with determined positions in such a way that the idle stroke between the piezoactuator and the adjustment element always keeps the given value despite the unavoidable manufacturing tolerances of the individual components.

For the surface grinding of the housing and baseplate of the piezoactuator, the latter is preferably clamped into a grinder, with the given voltage being applied via slip rings on the piezoactuator. The compensation collar consists preferably of soft iron or soft copper. During prestressing, the material of the compensation collar flows, which permanently changes the thickness of the compensation collar.

Alternatively, the piezoactuator can be surface ground before it is mounted, without voltage being applied. The idle stroke provided is adjusted via a boss on the prestressing device during deformation of the compensation collar. In this alternate embodiment, the prestressing device does not consist of a flat stamp but a stamp with an embossed face.

The diagram shows in cross-section a part of an injector for fuel injection into the combustion chamber of a combustion engine in the case of a common rail system. Piezoactuator 2 with housing 3 and baseplate 4 is screwed into housing 1 of the fuel injector. In housing 3 of piezoactuator 2 there is a piezoelement arrangement (not shown in detail) with which baseplate 4 makes a connection. If an electrical voltage is applied to the piezoelement arrangement via leads (also not shown), its length changes and baseplate 4 thereby changes its position relative to actor housing 3.

If electrically triggered, piezoactuator 2 acts on transfer element 5 in fuel injector housing 1. This means that when a voltage is applied to said piezoelement arrangement, baseplate 4 of piezoactuator 2 moves outward from the actuator housing, i.e. downward in the diagram, due to the longitudinal extension of the piezoelements caused by the voltage applied, and transfer element 5 is therefore also moved accordingly.

Transfer element 5 in fuel injector housing 1 acts, for its part, on valve lifter 6 which fits against valve element 7 of a servo valve. Valve element 7 is compressed by spring 8 into its valve seat as long as piezoactuator 2 is not triggered.

Instead of the transfer element 5 shown, hydraulic amplification of the stroke of piezoactuator 2 may also be provided. In general, baseplate 4 of piezoactuator 2 acts on an adjustment element for the servo valve of the fuel injector. Piezoactuator 2 and the adjustment element form the actuating drive for the servo valve.

When valve element 7 lifts up from its seat, i.e., when the servo valve opens, fuel can drain in the familiar manner (see for example U.S. Pat. No. 5,779,149 cited in the introduction) from the control chamber of the injection valve contained in the fuel injector past valve element 7, which lowers the pressure in the control chamber and opens the injection valve.

When the triggering of piezoactuator 2 ends and transfer element 5 and valve lifter 6 return to the starting position, valve element 7 of the servo valve is again compressed by spring 8 into its seat, so that the pressure in the control chamber of the injection valve is consequently again raised and the injection valve closes.

Between housing 3 of piezoactuator 2 and housing 1 of the fuel injector there is compensation collar 9.

When piezoactuator 2 is triggered, baseplate 4 of the piezoactuator moves relative to its housing 3 which, in the mounted state, is screwed firmly into housing 1 of the fuel injector. Transfer element 5, which may be a mechanical lever gear or a hydraulic amplifier, transfers this amplified movement to valve lifter 6 which actuates valve element 7 of the servo valve.

To set a defined idle stroke h in the actuating drive made up of piezoactuator 2, transfer element 5 and valve lifter 6, piezoactuator 2 is shaped in such a way before it is mounted into injector housing 1 that baseplate 4 stands back from housing 3 of the piezoactuator by exactly the given idle stroke distance h. For this purpose, exactly the voltage U which causes a longitudinal extension of the piezoelement arrangement corresponding to the given idle stroke h is applied to piezoactuator 2 before it is incorporated into injector housing 1, and housing 3 and baseplate 4 of piezoactuator 2 are surface ground when voltage U is applied.

For this purpose, piezoactuator 2 can be clamped into a grinder, for example, with voltage U being supplied via slip rings.

After the surface grinding process and removal of voltage U, baseplate 4 then 10 stands back from housing 3 of piezoactuator 2 by the given idle stroke h.

The manufacturing and other tolerances in the fuel injector are compensated for by compensation collar 9.

Compensation collar 9, which consists of a soft, deformable material such as soft iron or soft copper, is inserted into the fuel injector that is completely assembled up to piezoactuator 2. Instead of piezoactuator 2, a prestressing device 10 the face 11 of which corresponds to baseplate 4 and is completely flat is then screwed into the fuel injector. The prestressing device 10 is screwed in until the flat face 11 of the prestressing device 10 begins to lift valve element 7 of the servo valve up from its valve seat due to the actuation of transfer element 5. Compensation collar 9, which is made of a soft material, on which the flat face 11 of the prestressing device 10 also acts, is permanently deformed by flowing of the material. When the prestressing device 10 is removed, compensation collar 9 then retains the thickness which it had when the prestressing device 10 was screwed in far enough for the servo valve to begin to open.

Finally, if, instead of the prestressing device 10, piezoactuator 2, baseplate 4 of which stands back by given idle stroke h as described above, is screwed into housing 1 of the fuel injector as far as the stop, i.e., up to contact of piezoactuator housing 3 with compensation collar 9, the leading edge of piezoactuator housing 3 is located where the face 11 of the prestressing device 10 was when the servo valve began to open. Since, however, baseplate 4 of piezoactuator 2 stands back by given idle stroke h in the no-voltage state, the idle stroke of the actuating drive in the fuel injector, i.e., the play between baseplate 4 of piezoactuator 2 and the servo valve, corresponds exactly to given value h.

In an alternative method of proceeding, piezoactuator 2 is shaped in such a way before being mounted into injector housing 1 that baseplate 4 and housing 3 of piezoactuator 2 are surface ground in the mounting-ready state but without voltage being applied. After the grinding process, baseplate 4 of piezoactuator 2 is therefore at exactly the same location as housing 3 of piezoactuator 2. For this the prestressing device 10 for deforming compensation collar 9 does not have a flat face but a face bearing a boss 12 of height h at the point or points at which the prestressing device 10 acts on transfer element 5.

The central effective area 12 on the prestressing device 10 that engages transfer element 5 protrudes, in other words, in the mounting direction by given value h for the idle stroke compared with the effective area running around at the edge which engages with compensation collar 9.

Instead of piezoactuator 2, the prestressing device 10 is screwed, as for the first embodiment, into the fuel injector until valve element 7 of the servo valve begins to open due to the actuation of transfer element 5 by the raised section 12 on the face 11 of the prestressing device 10. Compensation collar 9 is thereby permanently deformed as above. Then, instead of the prestressing device 10, piezoactuator 2, at which housing 3 and base plate 4 have been surface ground without applied voltage, is screwed into housing 1 of the fuel injector as far as the stop on compensation collar 9.

In this embodiment the idle stroke also has exactly given value h between piezoactuator 2 and the servo valve, since the thickness of compensation collar 9 is adjusted with the prestressing device 10 in such a way that the servo valve begins to open only when the fuel injector is operated, after baseplate 4 of piezoactuator 2 has covered no-load path h when triggered.

The invention claimed is:

1. An injection valve comprising an injection valve housing having a threaded opening;

a piezoactuator, the piezoactuator having a piezoactuator housing with an opening, the piezoactuator housing having a thread operable to be engaged with the threaded opening of the injection valve housing, the piezoactuator being movable in the piezoactuator housing, wherein the piezoactuator moves in direction of the opening when triggered and wherein the piezoactuator is screwed in said injection valve housing with a variable distance between the piezoactuator and a transfer element arranged in said injection valve housing, and a compensation collar arranged between the piezoactuator housing and the injection valve housing having a thickness which defines a maximum for the variable distance between the piezoactuator and the transfer element when said piezoactuator housing is screwed into said injector valve housing such that the piezoactuator makes contact with said transfer element, wherein the thickness of the compensation collar completely compensates for any tolerance in an idle stroke distance between the piezoactuator and said transfer element when said piezoactuator is mounted within said injection valve housing, wherein the threaded opening of the injection valve housing is designed to allow insertion of a prestressing device for adjusting the thickness of the compensation collar and for insertion of the piezoactuator after said compensation collar has been adjusted.

2. An injection valve comprising:

a piezoactuator arranged within a piezoactuator housing and being arranged to be movable in the piezoactuator housing and driving a base plate when said piezoactuator is triggered, wherein the base plate is operable to make connection with a transfer element arranged in an injection valve housing, the piezoactuator housing being screwed in the injection valve housing wherein the base plate driven by the piezoactuator has a given idle stroke distance with respect to a leading edge of the piezoactuator housing, the leading edge of the piezoactuator housing is arranged at the level of the transfer element, and a compensation collar having a thickness arranged between the injection valve housing and the piezoactuator, wherein the piezoactuator does not deform the compensation collar when the piezoactuator is screwed into the injection valve and the thickness of the compensation collar thereby defines a vertical position of the piezoactuator within the injection valve housing when screwed into the injection valve housing thereby completely compensating for tolerances in the idle stroke distance.

3. Injection valve according to claim 2, wherein the compensation collar consists of a material which can be deformed by a prestressing device.

4. Injection valve according to claim 3, wherein the compensation collar consists of soft iron or soft copper.

5. Injection valve according to claim 2, wherein the thickness of the compensation collar has been adjusted by plastic deformation.

6. Injection valve according to claim 1, wherein the compensation collar consists of a material which can be deformed by a prestressing device.

7. Injection valve according to claim 6, wherein the compensation collar consists of soft iron or soft copper.

8. An injection valve comprising an injection valve housing having;

a piezoactuator, the piezoactuator having a piezoactuator housing with an opening, the piezoactuator being movable in the piezoactuator housing, wherein the piezoactuator moving moves a base plate of said piezoactuator in direction of the opening when triggered and wherein the piezoactuator housing is screwed into said injection valve housing, and a compensation collar arranged between the piezoactuator housing and the injection valve housing having a thickness, wherein the piezoactuator does not deform the compensation collar when the piezoactuator is screwed into the injection valve, and wherein the compensation collar defines a distance between the base plate of the piezoactuator and a transfer element to a predefined idle distance of said piezoactuator when screwed into said injection valve housing thereby completely compensating for tolerances in the idle stroke distance.

9. Injection valve according to claim 8, wherein the compensation collar consists of a material which can be deformed by a prestressing device.

10. Injection valve according to claim 9, wherein the compensation collar consists of soft iron or soft copper.

11. An injection valve comprising:

a piezoactuator arranged within a piezoactuator housing and being arranged to be movable in the piezoactuator housing and driving a base plate when triggered, wherein the base plate is operable to make connection with a transfer element arranged in an injection valve housing, the piezoactuator housing being screwed in the injection valve housing, wherein the base plate of the piezoactuator is aligned with a leading edge of the piezoactuator housing, the leading edge of the piezoactuator housing has a given idle stroke distance with respect to the transfer element, and a compensation collar having a thickness arranged between the injection valve housing and the piezoactuator completely compensating for tolerances in the idle stroke distance, wherein the piezoactuator does not deform the compensation collar when the piezoactuator is screwed into the injection valve and the compensation collar thereby limits.

12. Injection valve according to claim 11, wherein the compensation collar consists of a material which can be deformed by a prestressing device.

13. Injection valve according to claim 12, wherein the compensation collar consists of soft iron or soft copper.

14. Injection valve according to claim 11, wherein the thickness of the compensation collar has been adjusted by plastic deformation.

* * * * *